US008807157B2

(12) United States Patent
Simpson et al.

(10) Patent No.: US 8,807,157 B2
(45) Date of Patent: Aug. 19, 2014

(54) HOSE REELS

(75) Inventors: Martin Simpson, Lower Hutt (NZ); Nathan Marchant, Paraparaumu (NZ)

(73) Assignee: Fraser Fire & Rescure Limited, Lower Hutt (NZ)

( * ) Notice: Subject to any disclaimer, the term of this patent is extended or adjusted under 35 U.S.C. 154(b) by 0 days.

(21) Appl. No.: 13/996,789

(22) PCT Filed: Dec. 22, 2011

(86) PCT No.: PCT/NZ2011/000270
§ 371 (c)(1),
(2), (4) Date: Sep. 11, 2013

(87) PCT Pub. No.: WO2012/087159
PCT Pub. Date: Jun. 28, 2012

(65) Prior Publication Data

US 2013/0340855 A1 Dec. 26, 2013

(30) Foreign Application Priority Data

Dec. 22, 2010 (NZ) ..... 590142

(51) Int. Cl.
*A62C 35/00* (2006.01)

(52) U.S. Cl.
USPC ..... 137/355.21

(58) Field of Classification Search
USPC ..... 137/355.12, 355.2, 355.21, 355.26
See application file for complete search history.

(56) References Cited

U.S. PATENT DOCUMENTS

| | | | | |
|---|---|---|---|---|
| 3,662,197 | A * | 5/1972 | Worst | 310/78 |
| 3,868,005 | A * | 2/1975 | McMillan | 192/105 CS |
| 3,958,594 | A * | 5/1976 | Masters | 137/355.17 |
| 4,513,772 | A | 4/1985 | Fisher | |
| 5,211,203 | A * | 5/1993 | Vollweiler et al. | 137/355.17 |
| 6,672,329 | B1 | 1/2004 | Brooks et al. | |
| 6,802,336 | B1 | 10/2004 | Holmquist | |
| 7,316,368 | B2 | 1/2008 | Moon et al. | |
| 2002/0005451 | A1 | 1/2002 | Valverde | |
| 2007/0209711 | A1 * | 9/2007 | Morgan et al. | 137/355.2 |

FOREIGN PATENT DOCUMENTS

| | | |
|---|---|---|
| EP | 1 870 365 | 12/2007 |
| GB | 2 219 985 | 12/1989 |
| GB | 2 304 044 | 3/1997 |
| KR | 100429106 | 4/2004 |
| NZ | 220719 | 6/1987 |

OTHER PUBLICATIONS

International Search Report for International Application No. PCT/NZ2011/000270 mailed April 19, 2012 (3 pages).

* cited by examiner

*Primary Examiner* — John K. Fristoe, Jr.
*Assistant Examiner* — Kevin E Lynn
(74) *Attorney, Agent, or Firm* — Merchant & Gould P.C.

(57) ABSTRACT

A hose reel assembly including a drum assembly and a motor drive system, wherein: the motor drive system includes a drive motor arranged within the drum assembly and further arranged to drive the drum assembly from inside the drum assembly, wherein the drum assembly is arranged to axially rotate relative to the drive motor, and the drum assembly includes a removable access panel for providing access to the drive motor.

23 Claims, 5 Drawing Sheets

HOSE REELS

This application is a National Stage Application of PCT/NZ2011/000270, filed 22 Dec. 2011, which claims benefit of Serial No. 590,142, filed 22 Dec. 2010 in New Zealand and which applications are incorporated herein by reference. To the extent appropriate, a claim of priority is made to each of the above disclosed applications.

FIELD OF THE INVENTION

The present invention relates to improvements in hose reels. In particular, the present invention relates to a hose reel assembly including a motor drive system contained within a drum and a hose reel assembly with a removable access panel to provide access to a motor drive system within the drum.

BACKGROUND

Vehicles such as fire fighting vehicles (fire trucks and fire engines), mining vehicles etc include hose reels that may be attached to a water supply in order to direct water onto an area that needs to be doused, cooled down or extinguished.

These vehicles include many pieces of important equipment that are required by the operators of the vehicles, such as fire fighters for example, in order to enable the operators to perform their duties. Therefore, space on these vehicles is at a premium.

Although hose reels on these vehicles may be operated manually, it is preferable that they are operated with the aid of a motor drive circuit in order to feed out and wind in the hose in an efficient manner. Motors are used to rotate the hose reel drum and the rotation of the hose reel drum causes the hose to be fed out from, or to be wound back onto, the drum.

Prior known motor driven hose reel assemblies have used direct drive mechanisms that did not provide a drive coupling that provides an element of slippage. These types of arrangements therefore resulted in an increase in the wear and tear of the various drive components due to the increased force required when switching the drive circuit from a "feed out" mode to a "take up" mode.

It has also been known to utilise a mechanical clutch mechanism to drive hose reel assemblies.

Further, known reel assemblies have been formed from a drum with a bolt mechanism that passes through the entire length of the drum. The bolt mechanism is then used to attach each of two circular side portions to either side of the drum in order retain the hose on the drum. Alternatively, known reel assemblies have been formed from two opposing units, with each unit formed from a half drum and a single side portion. The two opposing units are then attached together at the central point of the drum. Both of these types of assemblies are particularly complex to manufacture.

One example of a fire hose reel mechanism is described in U.S. Pat. No. 4,513,772 by Fisher. This US patent describes an automatic hose reel that uses a clutch arrangement attached between the reel and an externally fitted motor. As the motor is external to the hose reel, additional space is required to accommodate the motor within the fire fighting vehicle.

A further example of a fire hose reel mechanism is described in U.S. Pat. No. 7,316,368 by Moon et al. This US patent describes a hose winding apparatus, which includes a clutch assembly coupled to a drive motor. Again, the drive motor is located external to the hose reel thus requiring the use of additional space to accommodate the motor.

In U.S. Pat. No. 6,802,336 by Holmquist, a hose reel apparatus is described where the motor is located internally within the hose drum. However, in order to access the motor assembly, e.g. for maintenance or repair purposes, it is required that the motor is completely removed from the assembly via a side mounting plate. Therefore, maintenance of the motor becomes a lengthy and complicated procedure resulting in the fire fighting vehicle being out of service for an increased amount of time.

An object of the present invention is to provide a hose reel assembly that provides easy access to the motor drive circuit.

A further object of the present invention is to provide a hose reel assembly that maximises the space requirements for fire fighting vehicles.

A further object of the present invention is to provide a hose reel assembly that provides a strong coupling and torque connection between the motor drive circuit and drum assembly, which can also provide slippage.

Each object is to be read disjunctively with the object of at least providing the public with a useful choice.

The present invention aims to overcome, or at least alleviate, some or all of the afore-mentioned problems.

SUMMARY OF THE INVENTION

It is acknowledged that the terms "comprise", "comprises" and "comprising" may, under varying jurisdictions, be attributed with either an exclusive or an inclusive meaning. For the purpose of this specification, and unless otherwise noted, these terms are intended to have an inclusive meaning—i.e. they will be taken to mean an inclusion of the listed components that the use directly references, but optionally also the inclusion of other non-specified components or elements.

It will be understood that, when describing various integers, such as modules, components, elements etc., any integer may be constituted by a single integer or multiple integers.

According to one aspect, the present invention provides a hose reel assembly including a drum assembly and a motor drive system, wherein: the motor drive system includes a drive motor arranged within the drum assembly and further arranged to drive the drum assembly from inside the drum assembly, wherein the drum assembly is arranged to axially rotate relative to the drive motor, and the drum assembly includes a removable access panel for providing access to the drive motor.

According to a further aspect, the present invention provides a hose reel assembly including a drum assembly and a motor drive system, wherein: the motor drive system includes a drive motor, a gear box and an electro-magnetic clutch all arranged within the drum assembly, the drive motor is arranged to drive the gear box, the gear box is arranged to drive the clutch, and the clutch is arranged to selectively rotate the drum assembly from inside the drum assembly to axially rotate the drum assembly relative to the drive motor.

BRIEF DESCRIPTION OF THE DRAWINGS

Embodiments of the present invention will now be described, by way of example only, with reference to the accompanying drawings, in which.

DETAILED DESCRIPTION OF THE INVENTION

First Embodiment

According to this first embodiment, a hose reel assembly is described that may be attached or fitted to a fire fighting vehicle, for example. It will be understood however, that as an alternative the hose reel assembly may be a standalone assembly.

Figure 1:
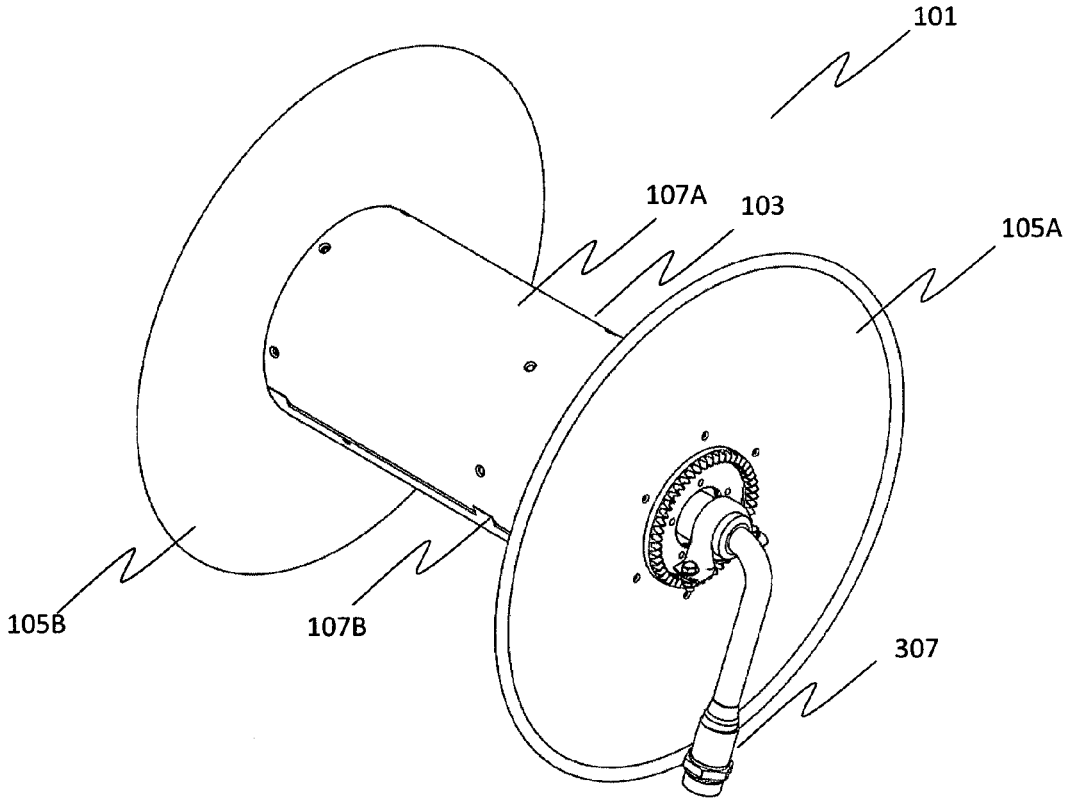
FIG. 1 shows a perspective view of an assembled reel assembly according to an embodiment of the present invention.

FIG. 1 shows a perspective view of an assembled reel assembly according to this embodiment.

The hose reel assembly 101 includes a main tubular drum assembly 103 with two opposing circular side portions (105A & 105B) located against the ends of the drum assembly to retain the hose on the drum. That is, each of the side portions (105A & 105B) provides an end stop to restrict the hose when it is being wound onto the drum 103 and so stop the hose from falling off either side of the drum 103.

The main parts of the drum assembly 103 in this embodiment are formed from powder coated aluminium. It will be understood that other suitable materials may be used as alternatives, such as sheet steel for example.

The drum assembly surface upon which a fire hose is arranged to rest is formed by two curved portions (107A, 107B) of aluminium. Each portion is formed into a C-shaped semi-circle such that when the two pieces have their open edges placed against each other a tubular shape is formed to create the drum. Therefore a lower C-shaped section forms the lower portion of the drum, and an upper C-shaped section forms the upper portion of the drum. Each of the C-shaped sections is formed by incrementally folding a flat sheet of aluminium at a specified distance. This provides a ridged surface which improves the strength of the formed components. Alternatively, the C-shaped sections could be pressed into the required form.

Figure 2:
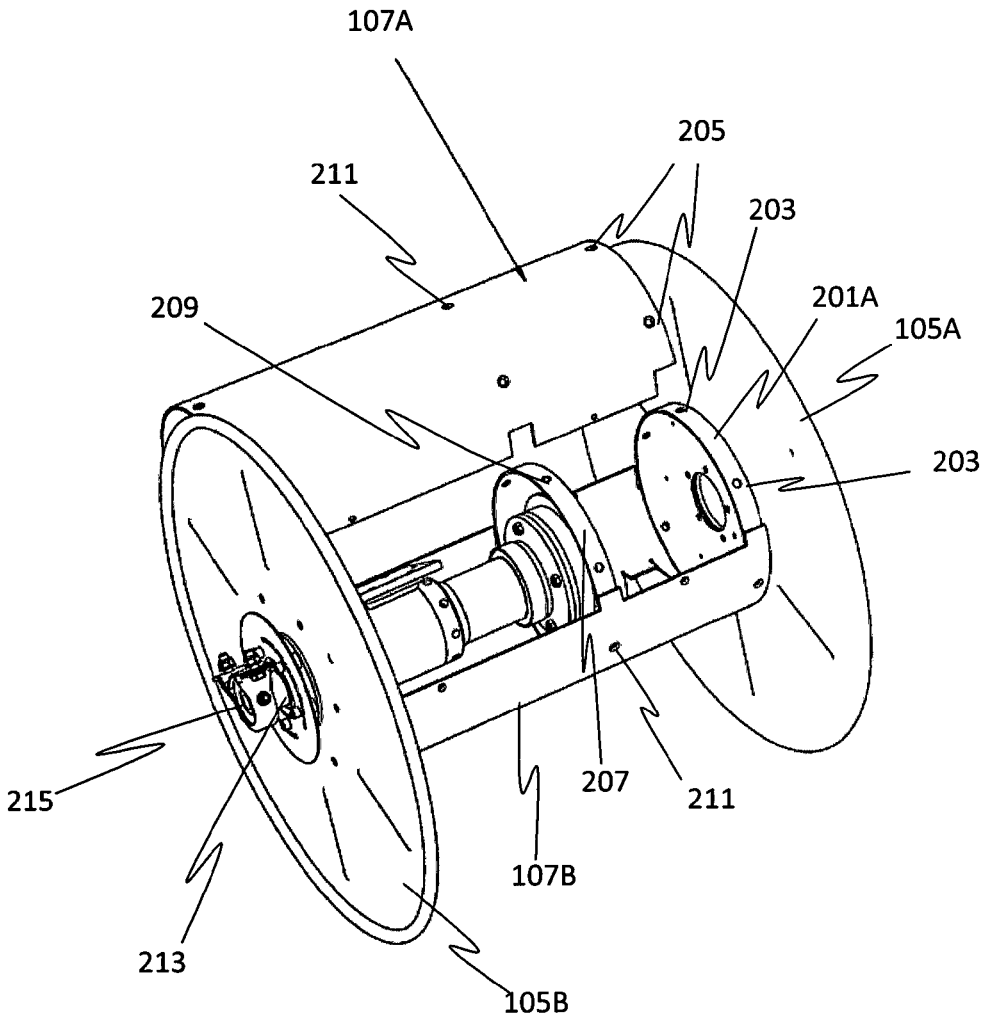
FIG. 2 shows a perspective view of the reel assembly of FIG. 1 with an access panel removed according to an embodiment of the present invention.

FIG. 2 shows a perspective view of the reel assembly with an access panel removed, where the access panel in this embodiment is the upper curved portion of aluminium 107A forming the upper surface of the drum.

Circular side flanges 201A & 201B (also see FIG. 3) are provided on each of the opposing side portions 105A & 105B against which the upper and lower sections 107A & 107B of the drum 103 may be attached.

The flanges include attachment points 203 equally spaced around the flange which correspond to attachment points 205 along the edges of the upper and lower sections so that the upper and lower sections can be fixedly attached to the flanges to form the complete drum.

According to this embodiment, each side flange has six attachment points equally spaced around the circumference. The attachment points include a fixed nut, which is arranged to receive a bolt passed through the corresponding attachment points on the upper and lower sections. Therefore, the upper section may be completely removed or detached from the lower section.

It will be understood that, as an alternative, any number of attachment points may be used and different forms of attachments may be used other than a nut and bolt arrangement. For example, a clip arrangement may be used where the movement of the clip releases the upper section so it can move away from the lower section.

Further, it will be understood that, as a further alternative, one side of the upper section may be pivotally connected to the lower section by way of a hinge mechanism. The hinge mechanism includes a first component attached to the lower section and a second component attached to the upper section, where the first and second components are in pivotal communication with each other. The hinge mechanism enables the upper section to be pivotally moved away from the lower section while still being attached to the lower section along one edge.

Further, it will be understood that, as a further alternative, the upper section may be made from multiple sections, where a first upper section is semi-permanently attached to the lower section and a second upper section may be moved relative to the first upper section, either pivotally, via a hinge or clip, or by being completely removed.

Therefore, the upper section of the drum assembly may be moved away from the lower section of the drum assembly to gain access to the internal cavity of the drum and the components that are within the drum assembly, as shown in FIG. 2 and explained in more detail below. Effectively, the upper section 107A (or at least part of it) is used as an access panel or port to gain access to the internal components within the drum assembly.

A central flange 207 is also provided in a central internal portion of the drum.

According to this embodiment, this central flange 207 also has six attachment points 209 equally spaced around the circumference of the flange so that the flange can be fixedly attached to the upper and lower sections of the drum through corresponding attachment points 211 on the upper and lower sections of the drum. As an alternative, it will be understood that any number or type of attachment points may be used on the central flange in the same way as herein described with reference to the side flanges.

According to this embodiment, the central flange is located just off centre of the drum assembly. However, it will be understood that the central flange may be located on either side of a central point along the drum's axis or in the exact centre.

Figure 3:
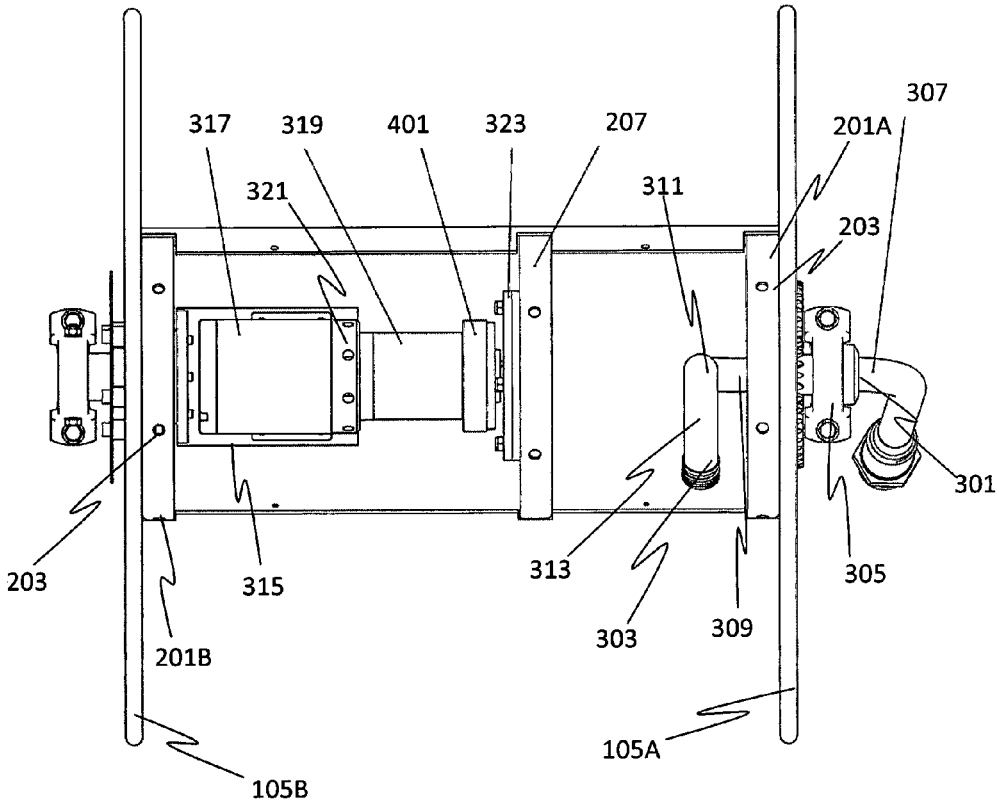
FIG. 3 shows a plan view of the internal components of a reel assembly according to an embodiment of the present invention.

FIG. 3 shows a plan view of the internal components of the reel assembly.

The right hand side portion 105A of the drum assembly includes a centrally positioned aperture that accommodates a swivel joint 301 that connects to a hose connection pipe 303. The swivel joint connects via a bearing 305 to a water supply connection 307 so that the swivel joint may rotate with the drum assembly while being in fluid connection with the water supply. The hose connection pipe connects to a hose (not shown). Therefore, the hose connection pipe 303 rotates with the drum via the swivel joint 305. A first portion 309 of the hose connection pipe extends from the swivel joint and then bends at a right angle to form a second portion 311. The second portion of the hose connection pipe includes a straight extension portion that extends from the bend in a direction parallel to the surface of the right hand side portion 105A of the drum assembly that opposes the left hand side portion 105B of the drum assembly. A third portion 313 of the hose connection pipe forms a bend so it tracks the outer surface of the lower section 107B of the drum assembly. The lower section of the drum assembly includes a cut out portion (see 501 in FIG. 5) that allows the hose connection pipe 303 to pass from the internal cavity of the drum assembly to an area outside the drum assembly. At the distal end of the hose connection pipe is formed any suitable connection piece for connecting to a water hose.

The left hand side portion 105B of the drum assembly includes a centrally positioned aperture that accommodates a bearing (see 213 of FIG. 2) through which is arranged a motor support arrangement 315 upon which a motor 317 is located. The motor support 315 remains static while the drum rotates around it. That is, the support arrangement 315 is fixed in position relative to the ground or the fire fighting vehicle in which the fire hose assembly is located (depending on whether the fire hose assembly is a standalone assembly of part of the fire fighting vehicle). The bearing 213 is fixedly attached to the left hand side portion 105B of the drum assembly. A channel (see 215 in FIG. 2) is also provided through the motor support to allow power and control cables that provide the power and/or drive signals to the components to be fed into the internal cavity of the drum assembly to control the motor drive system.

Figure 4:
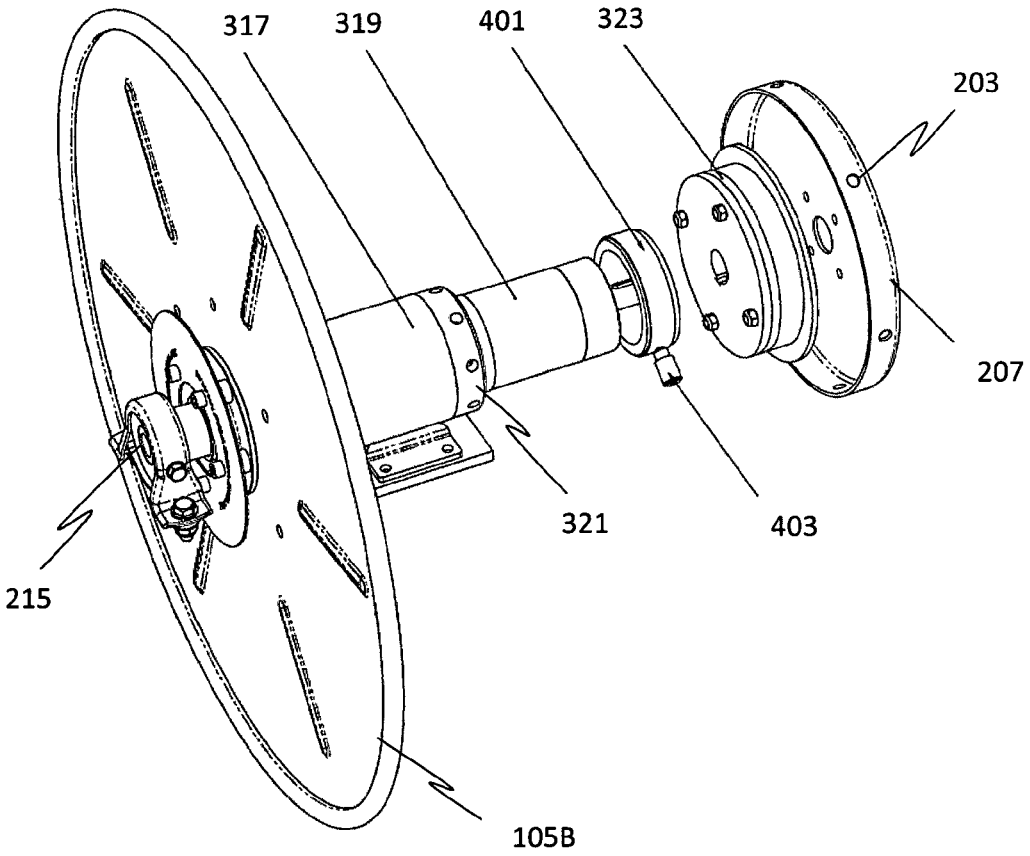
FIG. 4 shows the internal components of a reel assembly according to an embodiment of the present invention.

FIG. 4 shows some of the internal components of the reel assembly.

Inside the internal cavity of the drum assembly is a 24 Volt 27 Amp DC motor 317. Power to the motor is provided by the power and control cables. The motor 317 is positioned so that its drive shaft (or axle) lies along the same axis as the central axis of the drum assembly, which is in line with the apertures within the left and right hand side portions of the drum assembly. That is, the axis along which the drive shaft of the motor lies is the axis around which the drum assembly rotates. The drive motor is in a fixed position while the drum assembly rotates around the drive motor. The motor used in this embodiment has high torque which enables the motor to efficiently wind up the hose.

It will be understood that alternative motors may be used. For example, the motor may be a 22 Amp 260 Watt motor. As a further alternative, the motor may be a 12 Volt motor.

It will be understood that the drive motor may be any other suitable drive motor other than that specifically described in this embodiment.

The drive motor is connected to a gearbox 319 via an adaptor plate 321. The gear box in this embodiment is a planetary (epicyclic) gearbox with a 1:234 gear ratio. It will be understood however that alternative types of gearboxes and/or different gear ratios may be used. For example, the gear ratios may be 1:116, 1:234, 1:98, 1:90, or indeed any other suitable ratio.

The gear box assembly is connected to the clutch assembly 323. According to this embodiment, the clutch assembly includes an electromagnetic clutch. The electromagnetic clutch is engaged by applying the drive signal from the drive module, which is provided by the power and control cables. By energising the coil of the clutch, the armature of the clutch is forced towards the rotor of the clutch thus transferring the rotational movement of the rotor to the armature. The amount of rotational movement is controlled by the amount of energy used to energise the clutch coil (i.e. the voltage applied across the coil). By reducing or removing the power source across the coil, the clutch is allowed to slip. If all power is removed, for example if there is a total failure in the power source, the armature of the clutch is allowed to free wheel which enables the drum to be rotated manually, as will be understood in more detail below.

The armature of the electromagnetic clutch is fixedly attached to the central flange 207. Therefore, as the armature rotates, the central flange 207 also rotates. As the central flange is connected to the upper and lower portions (107A, 107B) of the drum 103, the drum rotates. Therefore, the clutch assembly drives the drum in a rotational manner from inside the drum, i.e. by driving an internal portion (the central flange) of the drum assembly. The central flange in this embodiment is located off centre along the axis of the drum assembly and so the rotational force applied to the drum assembly is applied generally towards the centre of the drum. This provides an even spread of rotational force across the drum axis to provide an efficient drive system.

As an alternative, as mentioned above, the central flange may be positioned nearer the centre of the rotational axis of the drum assembly than to the side portions of the drum assembly, or directly in the centre (i.e. away from the side portions of the drum assembly). As a further alternative, the central flange may also be positioned closer to the left or right hand side portions of the drum assembly if desired.

Figure 5:
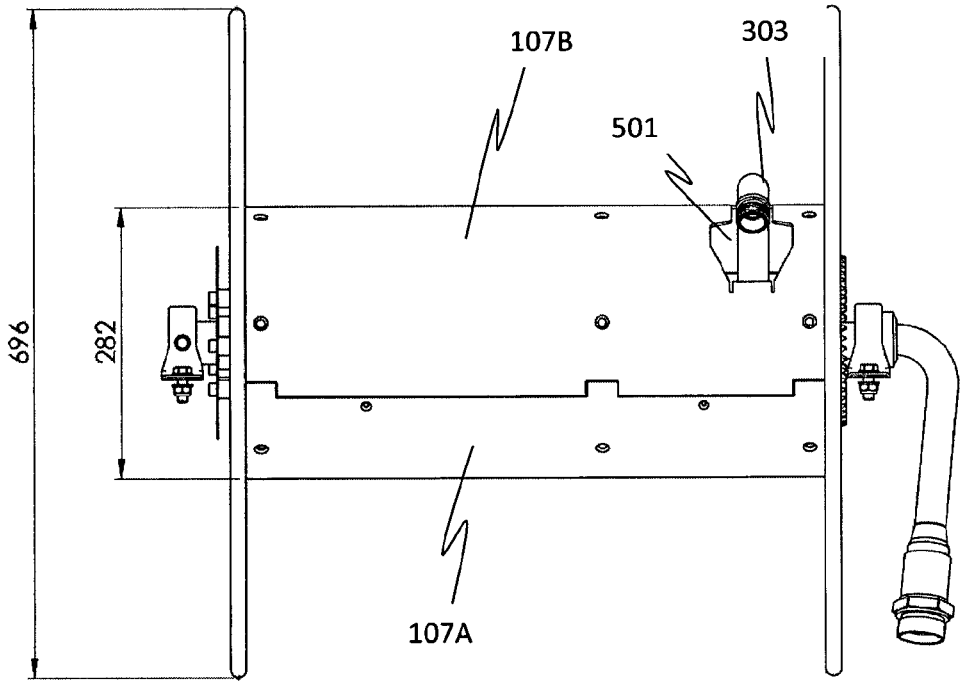
FIG. 5 shows a bottom view of an assembled reel assembly with an access panel attached according to an embodiment of the present invention.

FIG. 5 shows a bottom view of the assembled reel assembly with some preferred dimensions for the diameter of the drum shown as 282 mm and the diameter of each of the side portions shown as 696 mm. It will be understood that, as an alternative, the drum and side portion may be of any other suitable dimensions.

According to this embodiment, a drive module provides a single drive signal to both the motor and the electromagnetic clutch so that they are both switched on and off at the same time.

As a single drive signal is used to control the motor and clutch in this embodiment, the drum is operated in two modes.

According to the first mode, the drum is driven around due to the combination of the motor being driven and the clutch being fully engaged by the application of the drive signal to the motor and clutch.

According to a second mode, the drum is not driven and so is allowed to freely rotate or stop (i.e. it is freewheeling) as the drive signal is not being applied to the motor or the clutch, so the clutch is disengaged from the motor and the motor is not being driven.

The drive signal is fed to the clutch via a circular copper contact ring 401 via a brush contact 403 that is in rotatable contact with the coil of the electro-magnetic clutch. The drive signal cable is attached to the contact ring, which in turn allows the clutch to rotate within it. That is, the contact ring is stationary (in relation to the ground or body of the drive motor) and the electro-magnetic clutch rotates inside the ring.

As an alternative, an inductive coupling could be used instead of the contact ring to feed the drive signal to the electro-magnetic clutch.

This arrangement of components provides a significant advantage over devices that do not use electromagnetic clutches as they would be required to either have a reversible motor and gearbox assembly that enables the drum to be driven in reverse, or a disconnection device that releases the motor drive from the drum.

This is because the motor and gear box arrangements used to drive these types of hose reels would require a significant amount of force to cause them to manually turn in reverse. The slipping control mode enables a motor with a high torque value to be used.

The arrangements of the upper and lower portions of the drum assembly provide a mechanism by which access to the internal components of the drum assembly are easily achieved. For example, a user is easily able to access all the individual motor drive components for the purposes of repair, maintenance or servicing, including the drive motor, the gear box and the clutch assembly as well as the control and power cables. Further, a user is able to easily access the hose connection pipe in case it needs servicing or replacing.

The hose reel assembly also includes a brake assembly that is arranged to be in selective communication with the drum assembly. When the brake is activated, the brake applies friction to the rotating drum assembly to cause it to slow the rotation and stop the drum. According to this embodiment, the brake assembly includes a hand operated lever that applies a brake pad to the rotating drum assembly. It will be understood that alternative braking arrangements may be used. For example, a disk brake control module may be used in conjunction with a disk brake system for slowing the drum rotation down.

It will be understood that other braking mechanisms may be used as an alternative.

Further Embodiments

It will be understood that the embodiments of the present invention described herein are by way of example only, and that various changes and modifications may be made without departing from the scope of invention.

In an alternative embodiment, separate drive signals may be provided by the drive module to the motor and clutch in order to provide independent control over each.

By selectively activating the clutch assembly while the motor is operating, the drum may be selectively driven in a rotational manner. That is, the drive module develops a control signal that is fed to the electromagnetic clutch in order to selectively rotate the drum assembly. The drive module may either provide a binary control signal that either activates or deactivates the clutch, or may provide a variable control signal that provides a varied level of control between the active and deactivated states.

By de-activating the clutch assembly, the drum is allowed to free wheel, i.e. freely rotate without any effect from the motor drive, which enables the hose to be unreeled from the drum assembly manually without any significant resistance.

Through the use of the electromagnetic clutch, a controlled amount of slippage is provided by controlling the power applied to the clutch coil. Therefore, the drum may be operated in a number of different modes, as follows:

In a first mode, the clutch may be fully disengaged so that the drum is fully freewheeling, i.e. the armature of the drum is not in any significant magnetic contact with the rotor of the clutch and so can turn freely without the rotor having any significant effect. This may be particularly useful when unreeling the hose from the drum.

In a second mode, the clutch may be partially engaged to provide a level of resistance when the hose is being unreeled. This low level of resistance may stop the drum from over spinning (e.g. if the unreeling suddenly stopped) which could cause the hose on the drum to continue unreeling without it being taken up by the user. This may then result in the hose becoming tangled or kinked causing problems with water passing through the hose when in use.

In a third mode, the clutch may be fully engaged to enable the hose to be reeled back onto the drum. In this mode, the clutch is fully engaged and provides a strong coupling arrangement with high torque.

In a fourth mode, the clutch may be partially engaged to provide a level of slippage such that when the hose is being reeled back onto the drum, if any significant restrictive force is applied to the hose to stop it being wound up on the reel, e.g. by an operator of the hose reel device or due to the hose being caught by an obstacle, the clutch allows the armature to slip against the rotor so as not to damage the hose, clutch, gears or motor, or indeed anything or anyone caught up in the hose being reeled in.

According to a further embodiment, the present invention may include a flexible drive component that is positioned between the motor and the clutch to provide a degree of flexibility or "play" between the motor and the clutch. The flexible drive element allows for any misalignment between the motor and clutch. For example, the flexible drive element may be a hexagonal flexi-drive.

The invention claimed is:

1. A fire hose reel assembly including a drum assembly and a motor drive system, wherein:

the motor drive system includes a drive motor, a gear box and an electro-magnetic clutch all arranged within the drum assembly, the drive motor is arranged to drive the gear box, the gear box is arranged to drive the clutch, and the clutch includes a coil that may be energised to force an armature towards a rotor to selectively rotate the drum assembly from inside the drum assembly so as to axially rotate the drum assembly relative to the drive motor by driving an internal portion of the drum assembly that is positioned away from the sides of the drum assembly.

2. The fire hose reel assembly of claim 1, wherein the drum assembly includes a removable access panel for providing access to the drive motor.

3. The fire hose reel assembly of claim 1, further including a drive module arranged to provide one or more drive signals to drive the drive motor and electro-magnetic clutch.

4. The fire hose reel assembly of claim 3, wherein the drive module is arranged to provide a single drive signal that drives both the drive motor and electro-magnetic clutch at the same time.

5. The fire hose reel assembly of claim 1, wherein an axis formed by an axle of the drive motor is the same axis around which the drum assembly rotates.

6. The fire hose reel assembly of claim 1, wherein the drive motor is in a fixed position while the drum assembly rotates around the drive motor.

7. The fire hose reel assembly of claim 1, wherein the drive motor and drum assembly are positioned along the same axis.

8. The fire hose reel assembly of claim 1, wherein the electromagnetic clutch is arranged to selectively rotate the drum assembly by driving an internal portion of the drum assembly that is positioned towards the centre of the drum assembly.

9. The fire hose reel assembly of claim 8, wherein the internal portion of the drum assembly that is being driven is axially positioned in the centre of the drum assembly.

10. The fire hose reel assembly of claim 1, wherein the fire hose reel assembly further includes a hose connection means for connecting to a hose.

11. The fire hose reel assembly of claim 10, wherein the hose connecting means is arranged to rotate with the drum assembly.

12. The fire hose reel assembly of claim 10, wherein the hose connecting means includes a first connecting means for connection to a water supply, and a second connecting means for connection to a hose, wherein the first connecting means is connected axially through a first retaining portion of a hose retaining means.

13. The fire hose reel assembly of claim 12, wherein the second connecting means is arranged to pass through an aperture in the drum assembly.

14. The fire hose reel assembly of claim 1, wherein the drum assembly further includes a hose retaining means for retaining the hose on the drum assembly.

15. The fire hose reel assembly of claim 14, wherein the hose retaining means includes a first retaining portion and a second retaining portion, where the first retaining portion is arranged against a first distal end of the drum assembly and the second retaining portion is arranged against a second distal end of the drum assembly.

16. The fire hose reel assembly of claim 1, further including a brake assembly arranged to be in selective communication with the drum assembly.

17. The fire hose reel assembly of claim 16, wherein the brake assembly includes a disk brake module.

18. The fire hose reel assembly of claim 2, wherein the access panel is pivotally connected to the drum assembly.

19. The fire hose reel assembly of claim 2, wherein the access panel forms at least part of the drum assembly.

20. The fire hose reel assembly of claim 19, wherein the access panel forms at least part of an upper surface of the drum assembly.

21. The fire hose reel assembly of claim 2, wherein the access panel is fully detachable from the drum assembly.

22. The fire hose reel assembly of claim 2, wherein the access panel further provides access to a hose connection means.

23. The fire hose reel assembly of claim 2, wherein the access panel further provides access to one or both of the electromagnetic clutch and the gear box.

* * * * *